US009754608B2

(12) United States Patent
Souden et al.

(10) Patent No.: US 9,754,608 B2
(45) Date of Patent: Sep. 5, 2017

(54) NOISE ESTIMATION APPARATUS, NOISE ESTIMATION METHOD, NOISE ESTIMATION PROGRAM, AND RECORDING MEDIUM

(71) Applicant: NIPPON TELEGRAPH AND TELEPHONE CORPORATION, Chiyoda-ku (JP)

(72) Inventors: Mehrez Souden, Kyoto (JP); Keisuke Kinoshita, Kyoto (JP); Tomohiro Nakatani, Kyoto (JP); Marc Delcroix, Kyoto (JP); Takuya Yoshioka, Kyoto (JP)

(73) Assignee: NIPPON TELEGRAPH AND TELEPHONE CORPORATION, Chiyoda-ku (JP)

( * ) Notice: Subject to any disclaimer, the term of this patent is extended or adjusted under 35 U.S.C. 154(b) by 70 days.

(21) Appl. No.: 14/382,673

(22) PCT Filed: Jan. 30, 2013

(86) PCT No.: PCT/JP2013/051980

§ 371 (c)(1),
(2) Date: Sep. 3, 2014

(87) PCT Pub. No.: WO2013/132926

PCT Pub. Date: Sep. 12, 2013

(65) Prior Publication Data

US 2015/0032445 A1 Jan. 29, 2015

(30) Foreign Application Priority Data

Mar. 6, 2012 (JP) ..... 2012-049478

(51) Int. Cl.
*G10L 25/60* (2013.01)
*G10L 25/93* (2013.01)
(Continued)

(52) U.S. Cl.
CPC ..... *G10L 25/60* (2013.01); *G10L 21/0232* (2013.01); *G10L 21/0264* (2013.01);
(Continued)

(58) Field of Classification Search
None
See application file for complete search history.

(56) References Cited

U.S. PATENT DOCUMENTS 6,263,029 B1 * 7/2001 Alard ..... H04L 1/08 375/340
8,244,523 B1 * 8/2012 Murphy ..... G10L 25/84 381/71.11

(Continued)

OTHER PUBLICATIONS

Rennie, Steven, et al. "Dynamic noise adaptation." Acoustics, Speech and Signal Processing, 2006. ICASSP 2006 Proceedings. 2006 IEEE International Conference on. vol. 1. IEEE, 2006.*

(Continued)

*Primary Examiner* — Paras D Shah
*Assistant Examiner* — Jonathan Kim
(74) *Attorney, Agent, or Firm* — Oblon, McClelland, Maier & Neustadt, L.L.P.

(57) ABSTRACT

A noise estimation apparatus which estimates a non-stationary noise component on the basis of the likelihood maximization criterion is provided. The noise estimation apparatus obtains the variance of a noise signal that causes a large value to be obtained by weighted addition of the sums each of which is obtained by adding the product of the log likelihood of a model of an observed signal expressed by a Gaussian distribution in a speech segment and a speech posterior probability in each frame, and the product of the log likelihood of a model of an observed signal expressed by a Gaussian distribution in a non-speech segment and a non-speech posterior probability in each frame, by using
(Continued)

complex spectra of a plurality of observed signals up to the current frame.

14 Claims, 8 Drawing Sheets

(51) Int. Cl.
*G10L 25/27* (2013.01)
*G10L 21/0308* (2013.01)
*G10L 21/0264* (2013.01)
*G10L 21/0232* (2013.01)
*G10L 25/84* (2013.01)

(52) U.S. Cl.
CPC ..... *G10L 21/0308* (2013.01); *G10L 25/27* (2013.01); *G10L 25/93* (2013.01); *G10L 25/84* (2013.01)

(56) References Cited

U.S. PATENT DOCUMENTS

2003/0147476 A1* 8/2003 Ma ..... H04L 25/0204 375/329
2003/0191637 A1* 10/2003 Deng ..... G10L 21/0208 704/226
2006/0253283 A1* 11/2006 Jabloun ..... G10L 25/78 704/233
2007/0055508 A1* 3/2007 Zhao ..... G10L 21/0216 704/226
2009/0248403 A1* 10/2009 Kinoshita ..... H04R 3/04 704/219
2011/0015925 A1* 1/2011 Xu ..... G10L 15/20 704/233
2011/0044462 A1* 2/2011 Yoshioka ..... 381/66
2011/0238416 A1* 9/2011 Seltzer ..... G10L 15/20 704/233
2012/0041764 A1* 2/2012 Xu ..... G10L 15/065 704/256.1
2012/0275271 A1* 11/2012 Claussen ..... G01S 3/8006 367/118
2013/0054234 A1* 2/2013 Kim ..... G10L 21/0208 704/226
2013/0185067 A1* 7/2013 Ichikawa ..... G10L 15/20 704/233
2013/0197904 A1* 8/2013 Hershey ..... G10L 21/0216 704/226

OTHER PUBLICATIONS

Deng (Deng, Li, Jasha Droppo, and Alex Acero. "Recursive estimation of nonstationary noise using iterative stochastic approximation for robust speech recognition." Speech and Audio Processing, IEEE Transactions on 11.6 (2003): 568-580.).*
Cohen (Cohen, Israel. "Noise spectrum estimation in adverse environments: Improved minima controlled recursive averaging." Speech and Audio Processing, IEEE Transactions on 11.5 (2003): 466-475.).*
International Search Report issued Mar. 5, 2013, in PCT/JP13/051980 filed Jan. 30, 2013.
Cohen, "Noise Spectrum Estimation in Adverse Environments: Improved Minima Controlled Recursive Averaging", IEEE Transactions on Speech and Audio Processing, vol. 11, No. 5, Sep. 2003, pp. 466-475.
Martin, "Noise Power Spectral Density Estimation Based on Optimal Smoothing and Minimum Statistics", IEEE Transactions on Speech and Audio Processing, vol. 9, No. 5, Jul. 2001, pp. 504-512.
Deng, et al., "Recursive Estimation of Nonstationary Noise Using Iterative Stochastic Approximation for Robust Speech Recognition", IEEE Transactions on Speech and Audio Processing, vol. 11, No. 6, Nov. 2003, pp. 568-580.
Loizou, "Speech Enhancement: Theory and Practice", "Spectral-Subtractive Algorithms", CRC Press, Boca Raton, 2007, pp. 97-101.
Ephraim, et al. "Speech Enhancement Using a Minimum Mean-Square Error Short-Time Spectral Amplitude Estimator", IEEE Transactions on Acoustics, Speech, and Signal Processing, vol. ASSP-32, No. 6, Dec. 1984, pp. 1109-1121.
Loizou, "Speech Enhancement: Theory and Practice", "Evaluating Performance of Speech Enhancement Algorithms", CRC Press, Boca Raton, 2007, 8 pages.

* cited by examiner

IN MODULATED-WHITE-NOISE ENVIRONMENT

IN BUBBLE-NOISE ENVIRONMENT

NOISE ESTIMATION APPARATUS, NOISE ESTIMATION METHOD, NOISE ESTIMATION PROGRAM, AND RECORDING MEDIUM

TECHNICAL FIELD

The present invention relates to a technology for estimating a noise component included in an acoustic signal observed in the presence of noise (hereinafter also referred to as an "observed acoustic signal") by using only information included in the observed acoustic signal.

BACKGROUND ART

In the subsequent description, symbols such as "~" should be printed above a letter but will be placed after the letter because of the limitation of text notation. These symbols are printed in the correct positions in formulae, however. If an acoustic signal is picked up in a noisy environment, that acoustic signal includes the sound to be picked up (hereinafter also referred to as "desired sound") on which noise is superimposed. If the desired sound is speech, the clarity of speech contained in the observed acoustic signal would be lowered greatly because of the superimposed noise. This would make it difficult to extract the properties of the desired sound, significantly lowering the recognition rate of automatic speech recognition (hereinafter also referred to simply as "speech recognition") systems. If a noise estimation technology is used to estimate noise, and the estimated noise is eliminated by some method, the clarity of speech and the speech recognition rate can be improved. Improved minima-controlled recursive averaging (IMCRA hereinafter) in Non-patent literature 1 is a known conventional noise estimation technology.

Prior to a description of IMCRA, an observed acoustic signal model used in the noise estimation technology will be described. In general speech enhancement, an observed acoustic signal (hereinafter referred to briefly as "observed signal") $y_n$ observed at time n includes a desired sound component and a noise component. Signals corresponding to the desired sound component and the noise component are respectively referred to as a desired signal and a noise signal and are respectively denoted by $x_n$ and $v_n$. One purpose of speech enhancement processing is to restore the desired signal $x_n$ on the basis of the observed signal $y_n$. Letting signals after short-term Fourier transformation of signals $y_n$, $x_n$, and be $Y_{k,t}$, $X_{k,t}$, and $V_{k,t}$, where k is a frequency index having values of 1, 2, . . . , K (K is the total number of frequency bands), the observed signal in the current frame t is expressed as follows.

$$Y_{k,t}=X_{k,t}+V_{k,t} \tag{1}$$

In the subsequent description, it is assumed that this processing is performed in each frequency band, and for simplicity, the frequency index k will be omitted. The desired signal and the noise signal are assumed to follow zero-mean complex Gaussian distributions with variance $\sigma_x^2$ and variance $\sigma_v^2$ respectively.

The observed signal has a segment where the desired sound is present ("speech segment" hereinafter) and a segment where the desired sound is absent ("non-speech segment" hereinafter), and the segments can be expressed as follows with a latent variable H having two values $H_1$ and $H_0$.

$$Y_t=\begin{cases} X_t+V_t & \text{if } H=H_1 \\ V_t & \text{if } H=H_0 \end{cases} \tag{2}$$

The conventional method will be explained next with the variables described above.

IMCRA will be described with reference to FIG. 1. In a conventional noise estimation apparatus 90, first a minimum tracking noise estimation unit 91 obtains a minimum value in a given time segment of the power spectrum of the observed signal to estimate a characteristic (power spectrum) of the noise signal (refer to Non-patent literature 2).

Then, a non-speech prior probability estimation unit 92 obtains the ratio of the power spectrum of the estimated noise signal to the power spectrum of the observed signal and calculates a non-speech prior probability by determining that the segment is a non-speech segment if the ratio is smaller than a given threshold.

A non-speech posterior probability estimation unit 93 next calculates a non-speech posterior probability $p(H_0|Y_i;\theta_i^{\sim IMCRA})$ (1 or 0), assuming that the complex spectra of the observed signal and the noise signal after short-term Fourier transformation follow Gaussian distributions. The non-speech posterior probability estimation unit 93 further obtains a corrected non-speech posterior probability $\beta_{0,i}^{IMCRA}$ from the calculated non-speech posterior probability $p(H_0|Y_i;\theta_i^{\sim IMCRA})$ and an appropriately predetermined weighting factor $\alpha$.

$$\beta_{0,i}^{IMCRA}=(1-\alpha)p(H_0|Y_i;\tilde{\theta}_i^{IMCRA}) \tag{3}$$

A noise estimation unit 94 then estimates a variance $\sigma_{v,i}^2$ of the noise signal in the current frame i by using the obtained non-speech posterior probability $\beta_{0,i}^{IMCRA}$, the power spectrum $|Y_i|^2$ of the observed signal in the current frame, and the estimated variance $\sigma_{v,i-1}^2$ of the noise signal in the frame i−1 immediately preceding the current frame i.

$$\sigma_{v,i}^2=(1-\beta_{0,i}^{IMCRA})\sigma_{v,i-1}^2+\beta_{0,i}^{IMCRA}|Y_i|^2 \tag{4}$$

By successively updating the estimated variance $\sigma_{v,i}^2$ of the noise signal, varying characteristics of non-stationary noise can be followed and estimated.

PRIOR ART LITERATURE

Non-Patent Literature

Non-patent literature 1: I. Cohen, "Noise spectrum estimation in adverse environments: improved minima controlled recursive averaging", IEEE Trans. Speech Audio Process., September 2003, vol. 11, pp. 466-475

Non-patent literature 2: R. Martin, "Noise power spectral density estimation based on optimal smoothing and minimum statistics", IEEE Trans. Speech Audio Process., July 2001, vol. 9, pp. 504-512.

SUMMARY OF THE INVENTION

Problems to be Solved by the Invention

In the conventional technology, the non-speech prior probability, the non-speech posterior probability, and the estimated variance of the noise signal are not calculated on the basis of the likelihood maximization criterion, which is generally used as an optimization criterion, but are determined by a combination of parameters adjusted by using a rule of thumb. This has caused a problem that the finally estimated variance of the noise signal is not always optimum but is quasi-optimum based on the rule of thumb. If the successively estimated variance of the noise signal is quasi-optimum, the varying characteristics of non-stationary noise cannot be estimated while being followed appropriately. Consequently, it has been difficult to achieve a high noise cancellation performance in the end.

An object of the present invention is to provide a noise estimation apparatus, a noise estimation method, and a noise estimation program that can estimate a non-stationary noise component by using the likelihood maximization criterion.

Means to Solve the Problems

To solve the problems, a noise estimation apparatus in a first aspect of the present invention obtains a variance of a noise signal that causes a large value to be obtained by weighted addition of the sums each of which is obtained by adding the product of the log likelihood of a model of an observed signal expressed by a Gaussian distribution in a speech segment and a speech posterior probability in each frame, and the product of the log likelihood of a model of an observed signal expressed by a Gaussian distribution in a non-speech segment and a non-speech posterior probability in each frame, by using complex spectra of a plurality of observed signals up to the current frame.

To solve the problems, a noise estimation method in a second aspect of the present invention obtains a variance of a noise signal that causes a large value to be obtained by weighted addition of the sums each of which is obtained by adding the product of the log likelihood of a model of an observed signal expressed by a Gaussian distribution in a speech segment and a speech posterior probability in each frame, and the product of the log likelihood of a model of an observed signal expressed by a Gaussian distribution in a non-speech segment and a non-speech posterior probability in each frame, by using complex spectra of a plurality of observed signals up to the current frame.

Effects of the Invention

According to the present invention, a non-stationary noise component can be estimated on the basis of the likelihood maximization criterion.

DETAILED DESCRIPTION OF THE EMBODIMENTS

Figure 1:
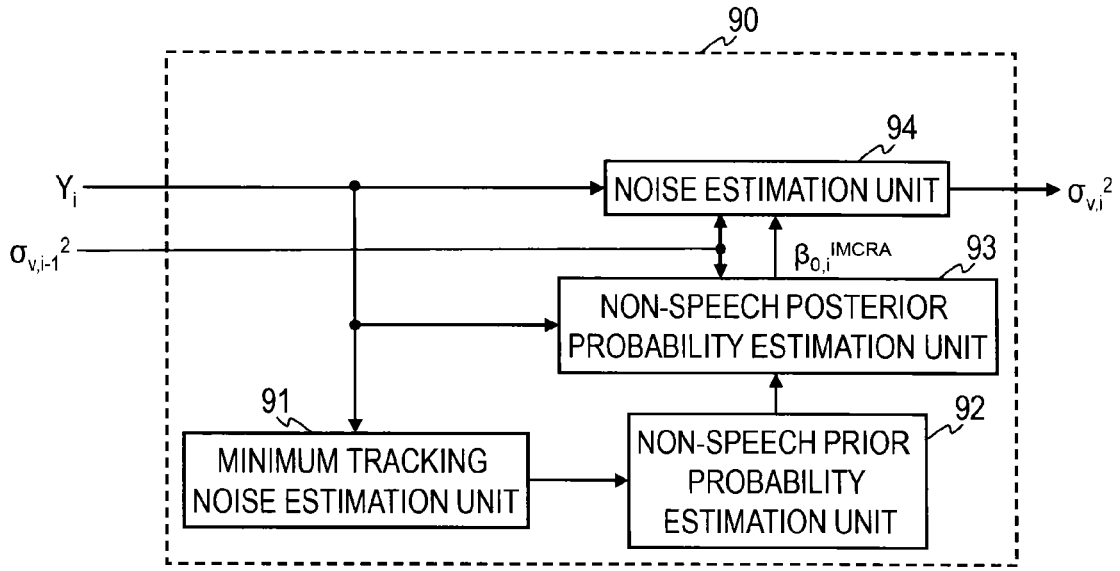
FIG. 1 is a functional block diagram of a conventional noise estimation apparatus.

Now, an embodiment of the present invention will be described. In the drawings used in the following description, components having identical functions and steps of performing identical processes will be indicated by identical reference characters, and their descriptions will not be repeated. A process performed in units of elements of a vector or a matrix is applied to all the elements of the vector or the matrix unless otherwise specified.

Noise Estimation Apparatus 10 According to First Embodiment

Figure 2:
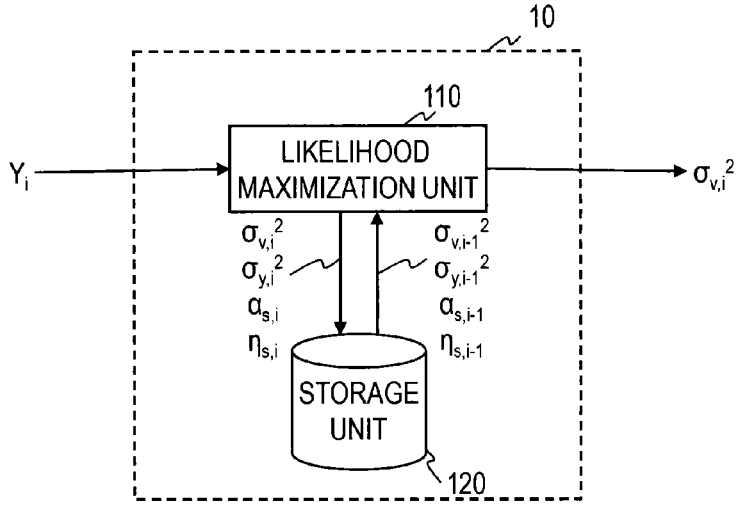
FIG. 2 is a functional block diagram of a noise estimation apparatus according to a first embodiment.
Figure 3:
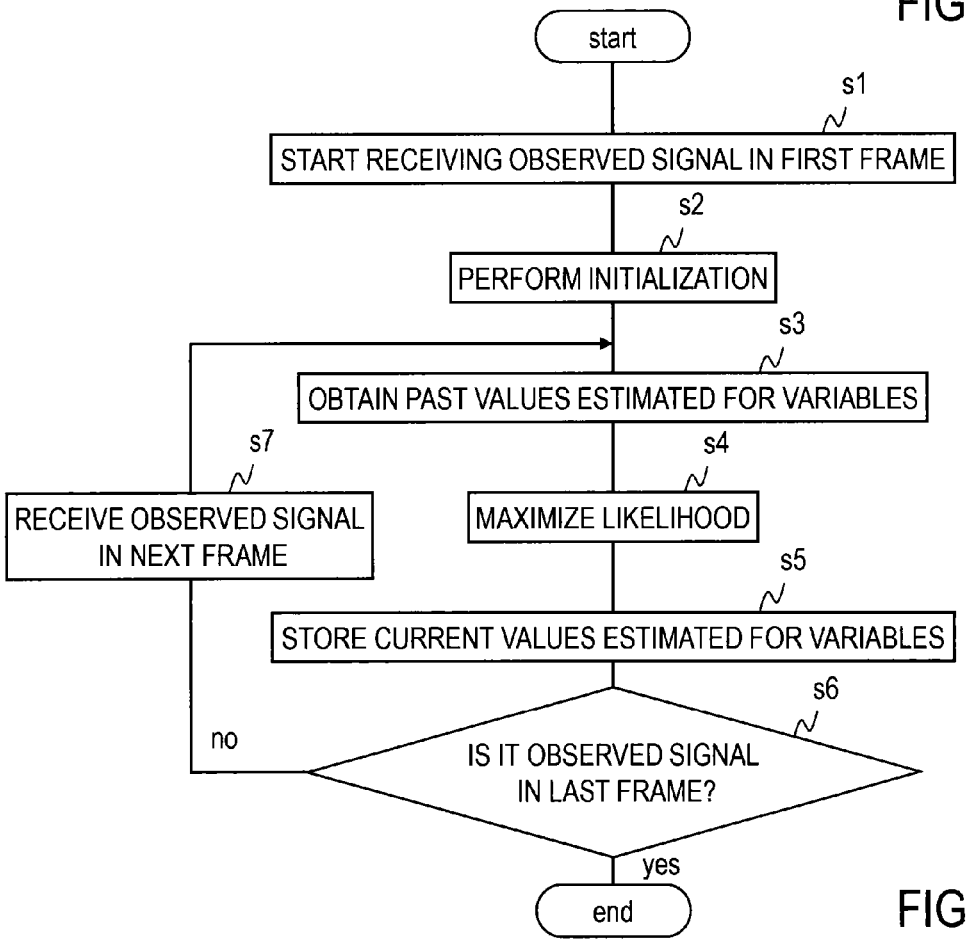
FIG. 3 is a view showing a processing flow in the noise estimation apparatus according to the first embodiment.

FIG. 2 shows a functional block diagram of a noise estimation apparatus 10, and FIG. 3 shows a processing flow of the apparatus. The noise estimation apparatus 10 includes a likelihood maximization unit 110 and a storage unit 120.

When reception of the complex spectrum $Y_i$ of the observed signal in the first frame begins (s1), the likelihood maximization unit 110 initializes parameters in the following way (s2).

$$\sigma_{v,i-1}^2=|Y_i|2$$

$$\sigma_{y,i-1}^2=|Y_i|2$$

$$\beta_{1,i-1}=1-\lambda$$

$$\alpha_{0,i-1}=\kappa$$

$$\alpha_{1,i-1}=1-\alpha_{0,i-1}$$

$$c_{0,i-1}=\alpha_{0,i-1}$$

$$c_{0,i-1}=\alpha_{1,i-1} \quad \text{(A)}$$

Here, $\lambda$ and $\kappa$ are set beforehand to a given value in the range of 0 to 1. The other parameters will be described later in detail.

When the likelihood maximization unit 110 receives the complex spectrum $Y_i$ of the observed signal in the current frame i, the likelihood maximization unit 110 takes from the storage unit 120 the non-speech posterior probability $\eta_{0,i-1}$, the speech posterior probability $\eta_{1,i-1}$, the non-speech prior probability $\alpha_{0,i-1}$, the speech prior probability $\alpha_{1,i-1}$, the variance $\sigma_{y,i-1}^2$ of the observed signal, and the variance $\sigma_{v,i-1}^2$ of the noise signal, estimated in the frame i−1 immediately preceding the current frame i, for successive estimation of the variance $\sigma_{v,i}^2$ of the noise signal in the current frame i (s3). On the basis of those values (or on the basis of the initial values (A), instead of the values taken from the storage unit 120, when the complex spectrum $Y_i$ of the observed signal in the first frame is received), by using the complex spectra $Y_0, Y_1, \ldots Y_i$ of the observed signal up to the current frame i, the likelihood maximization unit 110 obtains the speech prior probability $\alpha_{1,i}$, the non-speech prior probability $\alpha_{0,i}$, the non-speech posterior probability $\eta_{0,i}$, the speech posterior probability $\eta_{1,i}$, the variance $\sigma_{v,i}^2$ of the noise signal, and the variance $\sigma_{x,i}^2$ of the desired signal in the current frame i such that the value obtained by weighted addition of the sums each of which is obtained by adding the product of the log likelihood log $[\alpha_1 p(Y_t|H_1;\theta)]$ of a model of an observed signal expressed by a Gaussian distribution in a speech segment and the speech posterior probability $\eta_{1,t}(\alpha'_0,\theta')$ in each frame t (t=0, 1, . . . , i), and the product of the log likelihood log $[\alpha_1 p(Y_t|H_0;\theta)]$ of a model of an observed signal expressed by a Gaussian distribution in a non-speech segment and the non-speech posterior probability $\eta_{0,t}(\alpha'_0,\theta')$ in each frame t, as given below, is maximized (s4), and stores them in the storage unit 120 (s5).

$$Q_i(\alpha_0, \theta) = \sum_{t=0}^{i} \lambda^{i-t} \sum_{s=0}^{1} \eta_{s,t}(\alpha'_0, \theta')\log[\alpha_s p(Y_t \mid H_s; \theta)]$$

The noise estimation apparatus 10 outputs the variance $\sigma_{v,i}^2$ of the noise signal. Here, $\lambda$ is a forgetting factor and a parameter set in advance in the range $0<\lambda<1$. Accordingly, the weighting factor $\lambda^{i-t}$ decreases as the difference between the current frame i and the past frame t increases. In other words, a frame closer to the current frame is assigned a greater weight in the weighted addition. Steps s3 to s5 are repeated (s6, s7) up to the observed signal in the last frame. The likelihood maximization unit 110 will be described below in detail.

Parameter Estimation Method Based on Likelihood Maximization Criterion

An algorithm for estimating the above-described parameters on the basis of the likelihood maximization criterion will now be derived. First, the speech prior probability and the non-speech prior probability are defined respectively as $\alpha_1=P(H_1)$ and $\alpha_0=P(H_0)=1-\alpha_1$, and the parameter vector is defined as $\theta=[\sigma_v^2, \sigma_x^2]T$. It is noted that $\sigma_y^2$, $\sigma_x^2$, and $\sigma_v^2$ represent the variances of the observed signal, the desired signal, and the noise signal, respectively, and also their power spectra.

It is assumed as follows that the complex spectrum $Y_t$ of the observed signal follows a Gaussian distribution both in the speech segment and in the non-speech segment.

$$p(Y_t \mid H_0; \theta) = \frac{1}{\pi\sigma_v^2} e^{-\frac{|Y_t|^2}{\sigma_v^2}} \tag{5}$$

$$p(Y_t \mid H_1; \theta) = \frac{1}{\pi(\sigma_v^2 + \sigma_x^2)} e^{-\frac{|Y_t|^2}{\sigma_v^2+\sigma_x^2}}$$

With the above-described models, the non-speech prior probability $\alpha_0$, and the speech prior probability $\alpha_1$, the likelihood of the observed signal in the time frame t can be expressed as follows.

$$p(Y_t;\alpha_0,\theta)=\alpha_0 p(Y_t|H_0;\sigma_v^2)+\alpha_1 p(Y_t|H_1;\sigma_v^2,\sigma_x^2) \tag{6}$$

According to the Bayes' theorem, the speech posterior probability $\eta_{1,t}(\alpha_0,\theta)=p(H_1|Y_t;\alpha_0,\theta)$ and the non-speech posterior probability $\eta_{0,t}(\alpha_0,\theta)=p(H_0|Y_t;\alpha_0,\theta)$ can be defined as follows.

$$\eta_{s,t}(\alpha_0, \theta) = \frac{\alpha_s p(Y_t \mid H_s; \theta)}{\sum_{s'=0}^{1} \alpha_{s'} p(Y_t \mid H_{s'}; \theta)} \tag{7}$$

Here, s is a variable that has a value of either 0 or 1. With those models, parameters $\alpha_0$ and $\theta$ that maximize the likelihood defined by formula (6) can be estimated by repeatedly maximizing an auxiliary function. Specifically, by repeatedly estimating values $\alpha'_0$ and $\theta'$ of unknown optimum values of the parameters that maximize the auxiliary function $Q(\alpha_0,\theta)=E\{\log [p(Y_t,H;\alpha_0,\theta)]|Y_t;\alpha'_0,\theta'\}$, the (local) optimum values (estimated maximum likelihood) of the parameters can be obtained. Here, $E\{\bullet\}$ is an expectation calculation function. In this embodiment, since the variance of a non-stationary noise signal is estimated, the parameters $\alpha_0$ and $\theta$ to be estimated (latent variables of the expectation maximization algorithm) could vary with time. Therefore, instead of the usual expectation maximization (EM) algorithm, a recursive EM algorithm (reference 1) is used.

(Reference 1) L. Deng J. Droppo, and A. Acero, "Recursive estimation of nonstationary noise using iterative stochastic approximation for robust speech recognition", IEEE Trans. Speech, Audio Process, November 2003, vol. 11, pp. 568-580

For the recursive EM algorithm, the following auxiliary function $Q_i(\alpha_0, \theta)$ obtained by transforming the auxiliary function given above is introduced.

$$Q_i(\alpha_0, \theta) = \sum_{t=0}^{i} \lambda^{i-t} \sum_{s=0}^{1} \eta_{s,t}(\alpha'_0, \theta')\log[\alpha_s p(Y_t \mid H_s; \theta)] \tag{8}$$

By maximizing the auxiliary function $Q_i(\alpha_0, \theta)$, the optimum parameter values $\alpha_{0,i}$, $\alpha_{i,1}$, $\theta_i=\{\sigma_{v,i}^2, \sigma_{x,i}^2\}$ in the time frame i can be obtained. If the optimum estimates in the immediately preceding frame i−1 have always been obtained ($\alpha'_s=\alpha_{s,i-1}$, and $\theta'=\theta_{i-1}$ are assumed), the optimum parameter value $\alpha_{0,i}$ can be obtained by partially differentiating the function $L(\alpha_0, \theta)=Q_i(\alpha_0, \theta)+\mu(\alpha_1+\alpha_0-1)$ with respect to $\alpha_1$ and $\alpha_0$ and zeroing the result. Here, $\mu$ represents the Lagrange undetermined multiplier (adopted for optimization under the constraint $\alpha_1+\alpha_0=1$).

Through this operation, the following updating formula can be obtained.

$$\alpha_{s,i}c_i=c_{si} \tag{9}$$

The variables in the formula are defined as follows.

$$c_{s,i} = \sum_{t=0}^{i} \lambda^{i-t}\eta_{s,t}(\alpha_{0,i-1}, \theta_{i-1}) \tag{10}$$

$$c_i = c_{0,i} + c_{1,i} \tag{11}$$

Formula (10) can be expanded as follows.

$$c_{si}=\lambda c_{s,i-1}+\eta_{s,i}(\alpha_{0,i-1},\theta_{i-1}) \tag{12}$$

By partially differentiating the auxiliary function $Q(\alpha_0,\theta)$ with respect to $\sigma_v^2$ and $\sigma_x^2$ and zeroing the result, the following formula can be obtained for s=1.

$$\sum_{t=0}^{i} \lambda^{i-t}\eta_{1,t}(\alpha_{0,i-1}, \theta_{i-1})\sigma_{y,i}^2 = \sum_{t=0}^{i} \lambda^{i-t}\eta_{1,t}(\alpha_{0,i-1}, \theta_{i-1})|Y_t|^2 \quad (13)$$

As for s=0, the following formula can be obtained.

$$\sum_{t=0}^{i} \lambda^{i-t}\eta_{0,t}(\alpha_{0,i-1}, \theta_{i-1})\sigma_{v,i}^2 = \sum_{t=0}^{i} \lambda^{i-t}\eta_{0,t}(\alpha_{0,i-1}, \theta_{i-1})|Y_t|^2 \quad (14)$$

By inserting formula (10) into the first term on the left side of formula (14) and expanding the right side, the following formula can be obtained.

$$c_{0,i}\sigma_{v,i}^2=\lambda c_{0,i-1}\sigma_{v,i-1}^2+\eta_{0,i}(\alpha_{0,i-1},\theta_{i-1})|Y_i|^2 \quad (15)$$

With formulae (12) and (15), a formula for successively estimating the variance $\sigma_{v,i}^2$ of the noise signal can be derived as follows.

$$\sigma_{v,1}^2=(1-\beta_{0,i})\sigma_{v,i-1}^2+\beta_{0,i}|Y_i|^2 \quad (16)$$

Here, $\beta_{0,i}$ is defined as a time-varying forgetting factor, as given below.

$$\beta_{0,i} = \frac{\eta_{0,i}(\alpha_{0,i-1}, \theta_{i-1})}{c_{0,i}} \quad (17)$$

With formulae (12) and (13), a formula for updating the variance $\sigma_{y,i}^2$ of the observed signal can also be obtained.

$$\sigma_{y,i}^2=(1-\beta_{1,i})\sigma_{y,i-1}^2+\beta_{1,i}|Y_i|^2 \quad (18)$$

Here, $\beta_{1,i}$ is defined as a time-varying forgetting factor, as given below.

$$\beta_{1,i} = \frac{n_{1,i}(\alpha_{0,i-1}, \theta_{i-1})}{c_{1,i}} \quad (19)$$

When $\sigma_{y,i}^2$ and $\sigma_{v,i}^2$ are estimated, $\sigma_{x,i}^2$ is estimated naturally ($\sigma_{y,i}^2=\sigma_{v,i}^2+\sigma_{x,i}^2$). Therefore, the estimation of and $\sigma_{y,i}^2$ is synonymous with the estimation of $\sigma_{x,i}^2$.

Likelihood Maximization Unit 110

Figure 4:
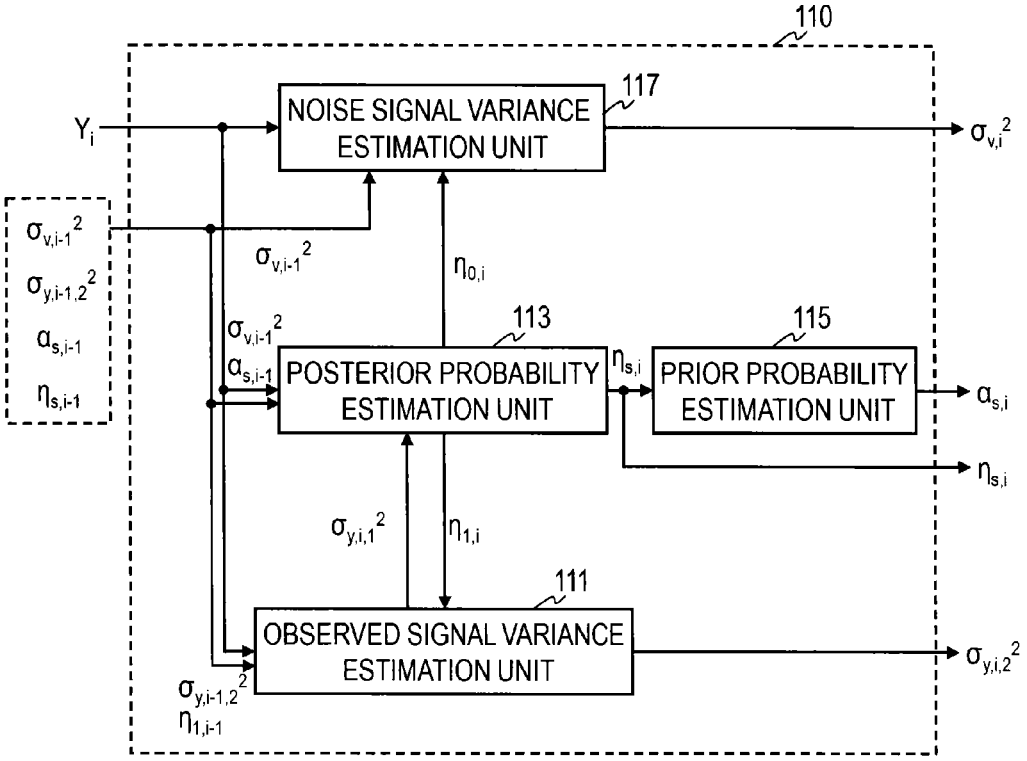
FIG. 4 is a functional block diagram of a likelihood maximization unit according to the first embodiment.
Figure 5:
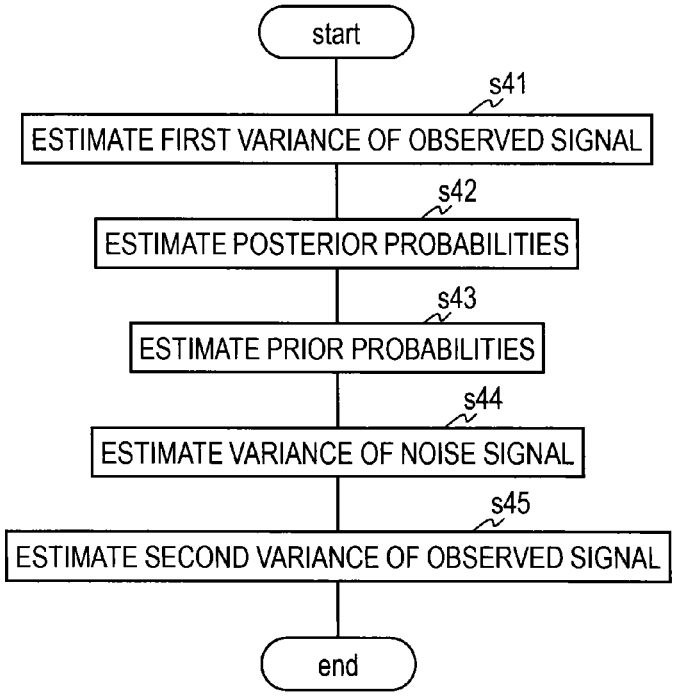
FIG. 5 is a view showing a processing flow in the likelihood maximization unit according to the first embodiment.

FIG. 4 shows a functional block diagram of the likelihood maximization unit 110, and FIG. 5 shows its processing flow. The likelihood maximization unit 110 includes an observed signal variance estimation unit 111, a posterior probability estimation unit 113, a prior probability estimation unit 115, and a noise signal variance estimation unit 117.

Observed Signal Variance Estimation Unit 111

The observed signal variance estimation unit 111 estimates a first variance $\sigma_{y,i,1}^2$ of the observed signal in the current frame i on the basis of the speech posterior probability $\eta_{1,i-1}(\alpha_{0,i-2},\theta_{1-2})$ estimated in the immediately preceding frame i−1, by weighted addition of the complex spectrum $Y_i$ of the observed signal in the current frame i and a second variance $\sigma_{y,i-1,2}^2$ of the observed signal estimated in the frame i−1 immediately preceding the current frame i. For example, the observed signal variance estimation unit 111 receives the complex spectrum $Y_i$ of the observed signal in the current frame i, and the speech posterior probability $\eta_{1,i-1}(\alpha_{0,i-2},\theta_{1-2})$ and the second variance $\sigma_{y,i-1,2}^2$ of the observed signal estimated in the immediately preceding frame i−1, uses those values to estimate the first variance $\sigma_{y,i,1}^2$ of the observed signal in the current frame i, as given below, (s41) (see formulae (18), (19), and (12)), and outputs the first variance to the posterior probability estimation unit 113.

$$\sigma_{y,i,1}^2 = (1-\beta_{1,i-1})\sigma_{y,i-1,2}^2 + \beta_{1,i-1}|Y_i|^2$$

$$\beta_{1,i-1} = \frac{n_{1,i-1}(\alpha_{0,i-2}, \theta_{i-2})}{c_{1,i-1}}$$

$$c_{1,i-1} = \lambda c_{1,i-2} + \eta_{1,i-1}(\alpha_{0,i-2}, \theta_{i-2})$$

When the complex spectrum $Y_i$ of the observed signal in the first frame is received, the first variance $\sigma_{y,i,1}^2$ is obtained from the initial values $\beta_{1,i-1}=1-\lambda$ and $\sigma_{y,i-1}^2=|Y_i|^2$ in (A) above, instead of using $\eta_{1,i-1}(\alpha_{0,i-2},\theta_{i-2})$ and $\sigma_{y,i-1,2}^2$.

The observed signal variance estimation unit 111 further estimates the second variance $\sigma_{y,i,2}^2$ of the observed signal in the current frame i on the basis of the speech posterior probability $\eta_{1,i}(\alpha_{0,i-1},\theta_{i-1})$ estimated in the current frame I, by weighted addition of the complex spectrum $Y_i$ of the observed signal in the current frame i and the second variance $\sigma_{y,i-1,2}^2$ of the observed signal estimated in the frame i−1 immediately preceding the current frame i. For example, the observed signal variance estimation unit 111 receives the speech posterior probability $\eta_{1,i}(\alpha_{0,i-1},\theta_{i-1})$ estimated in the current frame i, estimates the second variance $\sigma_{y,i,2}^2$ of the observed signal in the current frame i, as given below, (s45) (see formulae (18), (19), and (12)), and stores the second variance $\sigma_{y,i,2}^2$ as the variance $\sigma_{y,i}^2$ of the observed signal in the current frame i in the storage unit 120.

$$\sigma_{y,i,2}^2 = (1-\beta_{1,i})\sigma_{y,i-1,2}^2 + \beta_{1,i}|Y_i|^2$$

$$\beta_{1,i} = \frac{n_{1,i}(\alpha_{0,i-1}, \theta_{i-1})}{c_{1,i}}$$

$$c_{1,i} = \lambda c_{1,i-1} + \eta_{1,i}(\alpha_{0,i-1}, \theta_{i-1})$$

In the first frame, the initial value $c_{1,i-1}=\alpha_{0,i-1}=\kappa$ in (A) above is used to obtain $c_{1,i}$.

In other words, the observed signal variance estimation unit 111 estimates the first variance $\sigma_{y,i,1}^2$ by using the speech posterior probability $\eta_{1,i-1}(\alpha_{0,i-2},\theta_{i-2})$ estimated in the immediately preceding frame i−1 and estimates the second variance $\sigma_{y,i,2}^2$ by using the speech posterior probability $\eta_{1,i}(\alpha_{0,i-1},\theta_{i-1})$ estimated in the current frame i.

The observed signal variance estimation unit 111 stores the second variance $\sigma_{y,i,2}^2$ as the variance $\sigma_{y,i}^2$ in the current frame i in the storage unit 120.

Posterior Probability Estimation Unit 113

It is assumed that the complex spectrum $Y_i$ of the observed signal in a non-speech segment follows a Gaussian distribution determined by the variance $\sigma_{v,i-1}^2$ of the noise signal (see formula (5)) and that the complex spectrum $Y_i$ of the observed signal in a speech segment follows a Gaussian distribution determined by the variance σv,i-1$^2$ of the noise signal and the first variance $\sigma_{y,i,1}^2$ of the observed signal (see formula (5) where $\sigma_{y,i,1}^2=\sigma_{x,i-1}^2$). The posterior probability estimation unit 113 estimates the speech posterior probability $\eta_{1,i}(\alpha_{0,i-1},\theta_{i-1})$ and the non-speech posterior probability $\eta_{0,i}(\alpha_{0,i-1},\theta_{i-1})$ for the current frame i by using the complex spectrum $Y_i$ of the observed signal and the first variance $\sigma_{y,i,1}^2$ of the observed signal in the current frame i and the speech prior probability $\alpha_{1,i-1}$ and the non-speech prior probability $\alpha_{0,i-1}$ estimated in the immediately preceding frame i−1. For example, the posterior probability estimation unit 113 receives the complex spectrum $Y_i$ of the observed signal and the first variance $\sigma_{y,i,1}^2$ of the observed signal in the current frame i, the speech prior probability $\alpha_{1,i-1}$ and the non-speech prior probability $\alpha_{0,i-1}$, and the variance $\sigma_{v,i-1}^2$ of the noise signal estimated in the immediately preceding frame i−1, uses those values to estimate the speech posterior probability $\eta_{1,i}(\alpha_{0,i-1},\theta_{i-1})$ and the non-speech posterior probability $\eta_{0,i}(\alpha_{0,i-1},\theta_{i-1})$ for the current frame i, as given below, (s42) (see formulae (7) and (5)), and outputs the speech posterior probability $\eta_{1,i}(\alpha_{0,i-1},\theta_{i-1})$ to the observed signal variance estimation unit 111, the non-speech posterior probability $\eta_{0,i}(\alpha_{0,i-1},\theta_{i-1})$ to the noise signal variance estimation unit 117, and the speech posterior probability $\eta_{1,i}(\alpha_{0,i-1},\theta_{i-1})$ and the non-speech posterior probability $\eta_{0,i}(\alpha_{0,i-1},\theta_{i-1})$ to the prior probability estimation unit 115.

$$\eta_{s,i}(\alpha_{0,i-1},\theta_{i-1}) = \frac{\alpha_{s,i-1}\,p(Y_i \mid H_s;\theta_{i-1})}{\sum_{s'=0}^{1}\alpha_{s',i-1}\,p(Y_i \mid H_{s'};\theta_{i-1})}$$

$$p(Y_i \mid H_0;\theta_{i-1}) = \frac{1}{\pi\sigma_{v,i-1}^2}e^{-\frac{|Y_i|^2}{\sigma_{v,i-1}^2}}$$

$$p(Y_i \mid H_1;\theta_{i-1}) = \frac{1}{\pi(\sigma_{v,i-1}^2+\sigma_{x,i-1}^2)}e^{-\frac{|Y_i|^2}{\sigma_{v,i-1}^2+\sigma_{x,i-1}^2}}$$

$$\sigma_{x,i-1}^2 = \sigma_{y,i,1}^2 - \sigma_{v,i-1}^2$$

In addition, the speech posterior probability $\eta_{1,i}(\alpha_{0,i-1},\theta_{i-1})$ and the non-speech posterior probability $\eta_{0,i}(\alpha_{0,i-1},\theta_{i-1})$ are stored in the storage unit 120. When the complex spectrum $Y_i$ of the observed signal in the first frame i is received, the initial value $\sigma_{v,i-1}^2=|Y_i|^2$ in (A) above is used to obtain $\sigma_{x,i-1}^2$, and the initial values $\alpha_{0,i-1}=\kappa$ and $\alpha_{1,i-1}=1-\alpha_{0,i-1}=1-\kappa$ are used to obtain $\eta_{1,i}(\alpha_{0,i-1},\theta_{i-1})$ and $\eta_{0,i}(\alpha_{0,i-1},\theta_{i-1})$.

Prior Probability Estimation Unit 115

The prior probability estimation unit 115 estimates values obtained by weighted addition of the speech posterior probabilities and the non-speech posterior probabilities estimated up to the current frame i (see formula (10)), respectively, as the speech prior probability $\alpha_{1,i}$ and the non-speech prior probability $\alpha_{0,i}$. For example, the prior probability estimation unit 115 receives the speech posterior probability $\eta_{1,i}(\alpha_{0,i-1},\theta_{i-1})$ and the non-speech posterior probability $\eta_{0,i}(\alpha_{0,i-1},\theta_{i-1})$ estimated in the current frame i, uses the values to estimate the speech prior probability $\alpha_{1,i}$ and the non-speech prior probability $\alpha_{0,i}$, as given below, (s43) (see formulae (9), (12), and (11)), and stores them in the storage unit 120.

$$\alpha_{s,i} = \frac{c_{s,i}}{c_i}$$

$$c_{s,i} = \lambda c_{s,i-1} + \eta_{s,i}(\alpha_{0,i-1},\theta_{i-1})$$

$$c_i = c_{0,i} + c_{1,i}$$

As for $c_{s,i-1}$, values obtained in the frame i−1 should be stored. For the initial frame i, the initial values $c_{0,i-1}=\alpha_{0,i-1}=\kappa$ and $c_{1,i-1}==1-\alpha_{0,i-1}=1-\kappa$ in (A) above are used to obtain $c_{s,i-1}$.

$c_{s,i-1}$ may be obtained from formula (10), but in that case, all of the speech posterior probabilities $\eta_{1,0}, \eta_{1,1}, \ldots, \eta_{1,i}$ and non-speech posterior probabilities $\eta_{0,0}, \eta_{0,1}, \ldots, \eta_{0,1}$ up to the current frame must be weighted with $\lambda^{1-t}$ and added up, which will increase the amount of calculation.

(Noise Signal Variance Estimation Unit 117)

The noise signal variance estimation unit 117 estimates the variance $\sigma_{v,i}^2$ of the noise signal in the current frame i on the basis of the non-speech posterior probability estimated in the current frame i, by weighted addition of the complex spectrum $Y_i$ of the observed signal in the current frame i and the variance $\sigma_{v,i-1}^2$ of the noise signal estimated in the frame i−1 immediately preceding the current frame i. For example, the noise signal variance estimation unit 117 receives the complex spectrum $Y_i$ of the observed signal, the non-speech posterior probability $\eta_{0,i}(\alpha_{0,i-1},\theta_{i-1})$ estimated in the current frame i, and the variance $\sigma_{v,i-1}^2$ of the noise signal estimated in the immediately preceding frame i−1, uses these values to estimate the variance $\sigma_{v,i}^2$ of the noise signal in the current frame i, as given below, (s44) (see formulae (16), (17)), and stores it in the storage unit 120.

$$\sigma_{v,i}^2 = (1-\beta_{0,i})\sigma_{v,i-1}^2 + \beta_{0,i}|Y_i|^2$$

$$\beta_{0,i} = \frac{\eta_{0,i}(\alpha_{0,i-1},\theta_{i-1})}{c_{0,i}}$$

$$c_{0,i} = \lambda c_{0,i-1} + \eta_{0,i}(\alpha_{0,i-1},\theta_{i,1})$$

The observed signal variance estimation unit 111 performs step s45 described above by using the speech posterior probability $\eta_{1,i}(\alpha_{0,i-1},\theta_{i-1})$ estimated in the current frame i after the process performed by the posterior probability estimation unit 113.

Effects

According to this embodiment, the non-stationary noise component can be estimated successively on the basis of the likelihood maximization criterion. As a result, it is expected that the trackability to time-varying noise is improved, and noise can be cancelled with high precision.

Simulated Results

The capability to estimate the noise signal successively and the capability to cancel noise on the basis of the estimated noise component were compared with those of the conventional technology and evaluated to verify the effects of this embodiment.

Parameters λ and κ required to initialize the process were set to 0.96 and 0.99, respectively.

To simulate a noise environment, two types of noise, namely, artificially modulated white noise and bubble noise (crowd noise), were prepared. Modulated white noise is highly time-varying noise whose characteristics change greatly in time, and bubble noise is slightly time-varying noise whose characteristics change relatively slowly. These types of noise were mixed with clean speech at different SNRs, and the noise estimation performance and noise cancellation performance were tested. The noise cancellation method used here was the spectrum subtraction method (reference 2), which obtains a noise-cancelled power spectrum by subtracting the power spectrum of a noise signal estimated according to the first embodiment from the power spectrum of the observed signal. A noise cancellation method that requires an estimated power spectrum of a noise signal for cancelling noise (reference 3) can also be combined, in addition to the spectrum subtraction method, with the noise estimation method according to the embodiment.

(Reference 2) P. Loizou, "Speech Enhancement Theory and Practice", CRC Press, Boca Raton, 2007

(Reference 3) Y. Ephraim, D. Malah, "Speech enhancement using a minimum mean square error short-time spectral amplitude estimator", IEEE Trans. Acoust. Speech Sig. Process., December 1984, vol. ASSP-32, pp. 1109-1121

Figure 6:
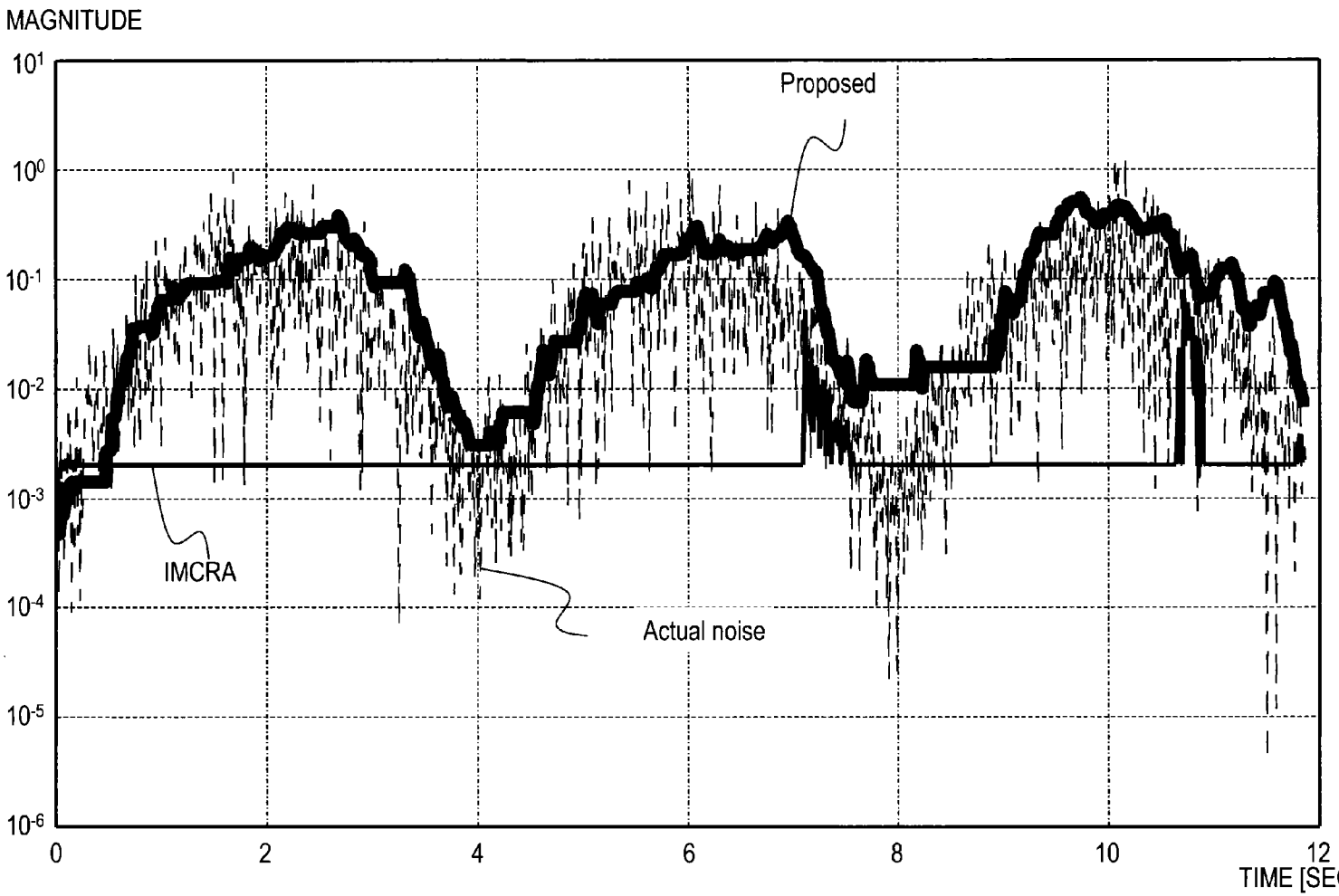
FIG. 6 is a view showing successive noise estimation characteristics of the noise estimation apparatus of the first embodiment and the conventional noise estimation apparatus.

FIG. 6 shows successive noise estimation characteristics of the noise estimation apparatus 10 according to the first embodiment and the conventional noise estimation apparatus 90. The SNR was 10 dB at that time. FIG. 6 indicates that the noise estimation apparatus 10 successively estimated non-stationary noise effectively, whereas the noise estimation apparatus 90 could not follow sharp changes in noise and made big estimation errors.

Figure 7:
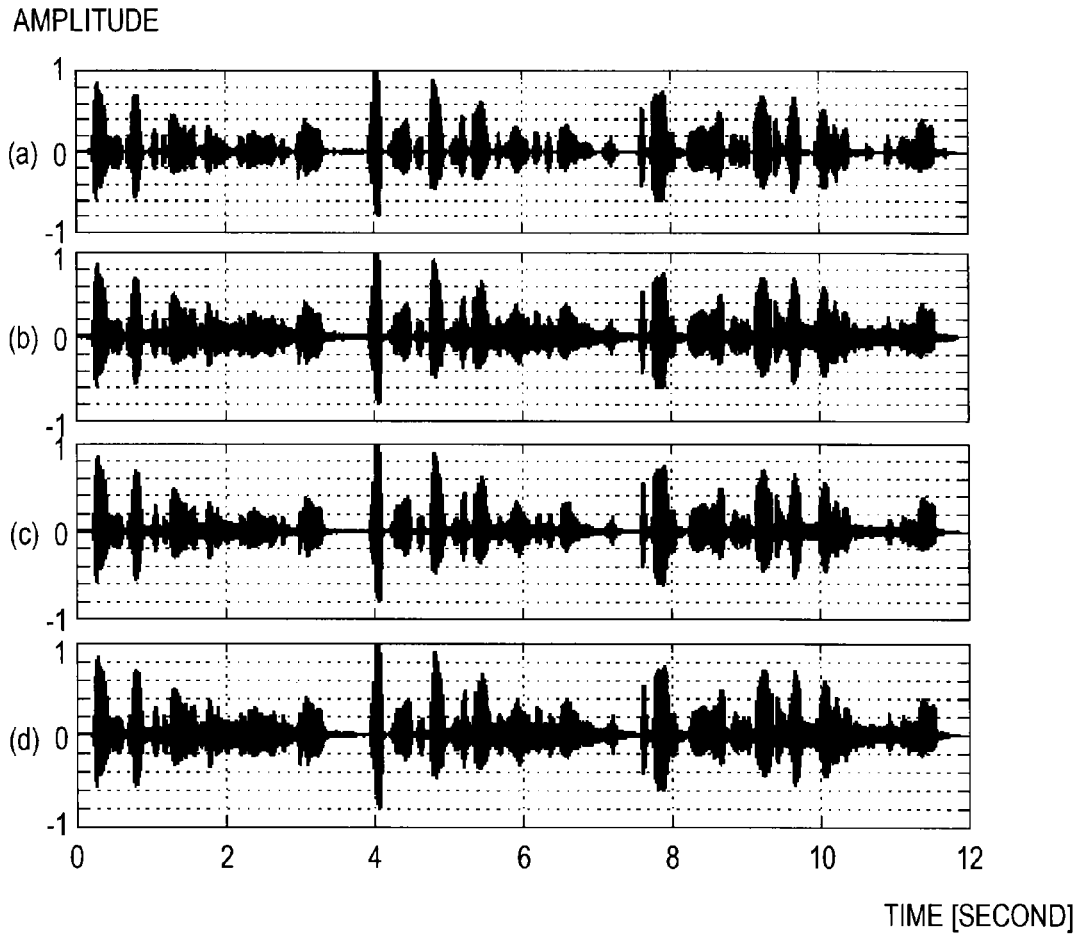
FIG. 7 is a view showing speech waveforms obtained by estimating noise and cancelling noise on the basis of the estimated variance of a noise signal in the noise estimation apparatus of the first embodiment and the conventional noise estimation apparatus.
Figure 8:
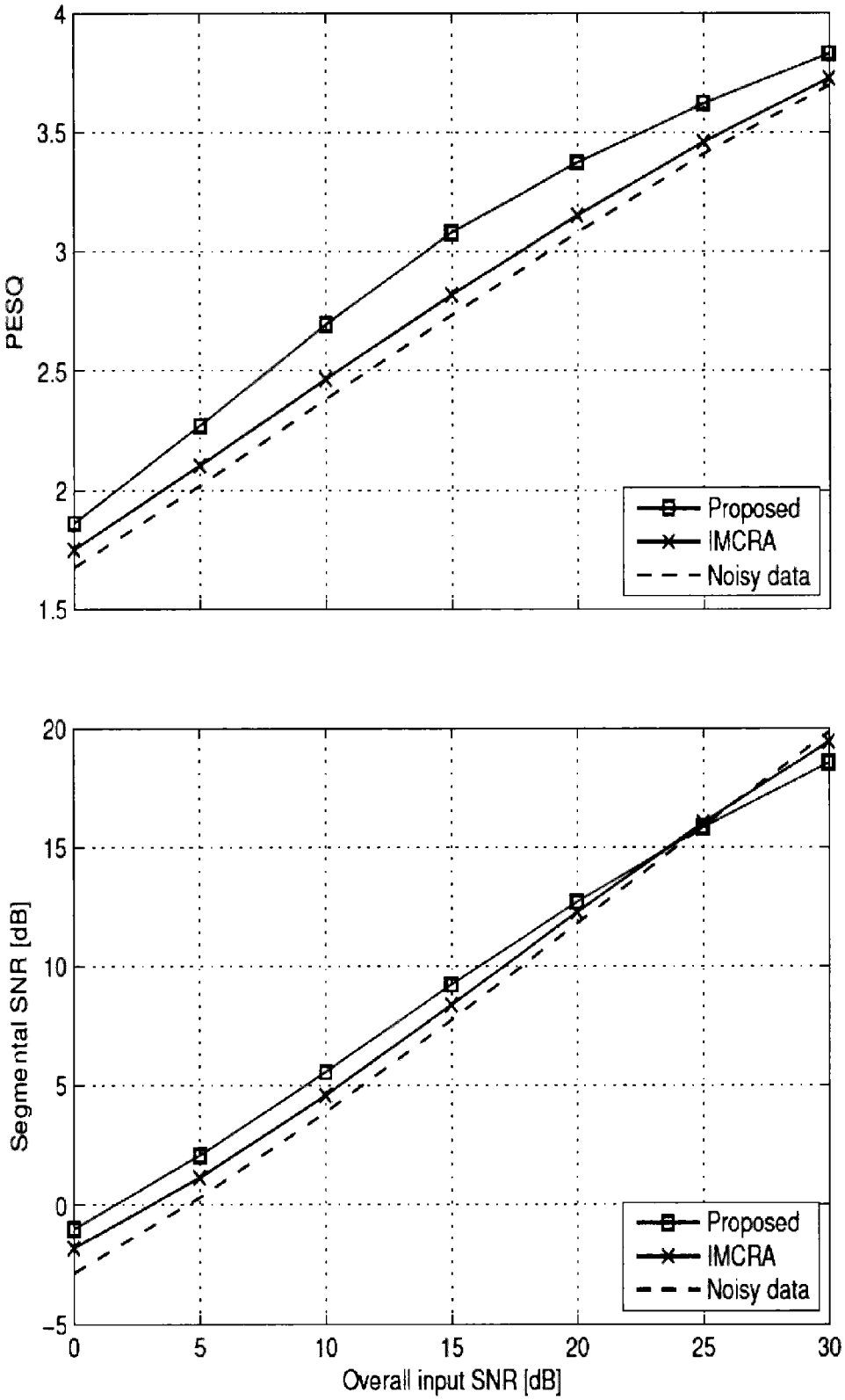
FIG. 8 is a view showing results of evaluation of the noise estimation apparatus of the first embodiment and the conventional noise estimation apparatus compared in a modulated white-noise environment.
Figure 9:
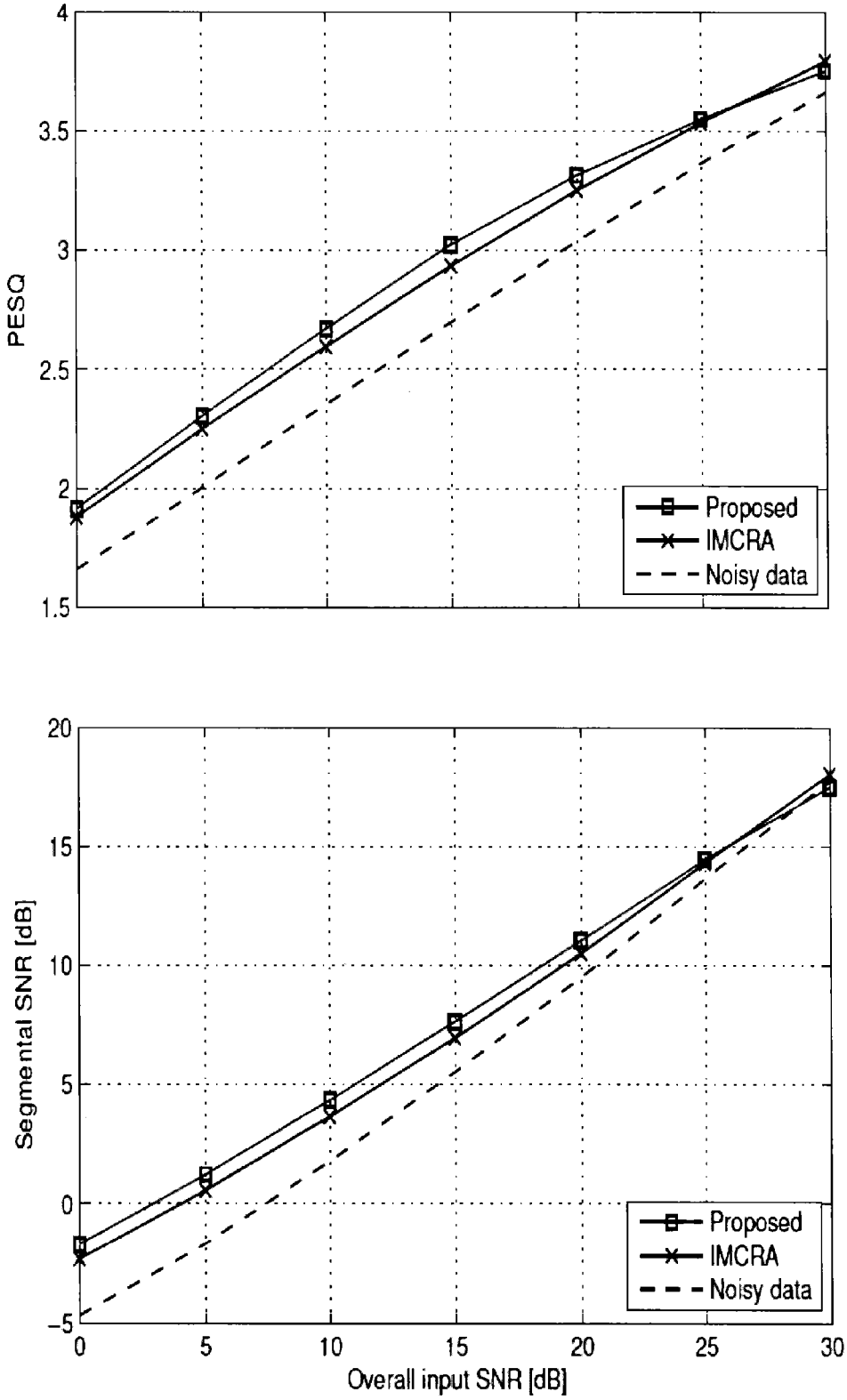
FIG. 9 is a view showing results of evaluation of the noise estimation apparatus of the first embodiment and the conventional noise estimation apparatus compared in a bubble noise environment.

FIG. 7 shows speech waveforms obtained by estimating noise with the noise estimation apparatus 10 and the noise estimation apparatus 90 and cancelling noise on the basis of the estimated variance of the noise signal. The waveform (a) represents clean speech; the waveform (b) represents speech with modulated white noise; the waveform (c) represents speech after noise is cancelled on the basis of noise estimation by the noise estimation apparatus 10; the waveform (d) represents speech after noise is cancelled on the basis of noise estimation by the noise estimation apparatus 90. In comparison with (d), (c) contains less residual noise. FIGS. 8 and 9 show the results of evaluation of the noise estimation apparatus 10 and the noise estimation apparatus 90 when compared in a modulated-white-noise environment and a bubble-noise environment. Here, the segmental SNR and PESQ value (reference 4) were used as evaluation criteria.

(Reference 4) P. Loizou, "Speech Enhancement Theory and Practice", CRC Press, Boca Raton, 2007

In the modulated-white-noise environment (see FIG. 8), the noise estimation apparatus 10 showed a great advantage over the noise estimation apparatus 90. In the bubble-noise environment (see FIG. 9), the noise estimation apparatus 10 showed slightly better performance than the noise estimation apparatus 90.

Modifications

Although $\beta_{1,i-1}$ is calculated in the step (s41) of obtaining the first variance $\sigma_{y,i,1}^2$ in this embodiment, $\beta_{1,i-1}$ calculated in the step (s45) of obtaining the second variance $\sigma_{y,i-1,2}^2$ in the immediately preceding frame i−1 may be stored and used. In that case, there is no need to store the speech posterior probability $\eta_{1,i}(\alpha_{0,i-1},\theta_{i-1})$ and the non-speech posterior probability $\eta_{0,i}(\alpha_{0,i-1},\theta_{i-1})$ in the storage unit 120.

Although $c_{0,i}$ is calculated in the step (s44) of obtaining the variance $\sigma_{v,i}^2$ in this embodiment, $c_{0,i}$ calculated in the step (s43) of obtaining prior probabilities in the prior probability estimation unit 115 may be received and used. Likewise, although $c_{1,i}$ is calculated in the step (s45) of obtaining the second variance $\sigma_{y,i,2}^2$, $c_{1,i}$ calculated in the step (s43) of obtaining prior probabilities in the prior probability estimation unit 115 may be received and used.

Although the first variance $\sigma_{y,i,1}^2$ and the second variance $\sigma_{y,i,2}^2$ are estimated by the observed signal variance estimation unit 111 in this embodiment, a first observed signal variance estimation unit and a second observed signal variance estimation unit may be provided instead of the observed signal variance estimation unit 111, and the first variance $\sigma_{y,i,1}^2$ and the second variance $\sigma_{y,i,2}^2$ may be estimated respectively by the first observed signal variance estimation unit and the second observed signal variance estimation unit. The observed signal variance estimation unit 111 in this embodiment includes the first observed signal variance estimation unit and the second observed signal variance estimation unit.

Figure 10:
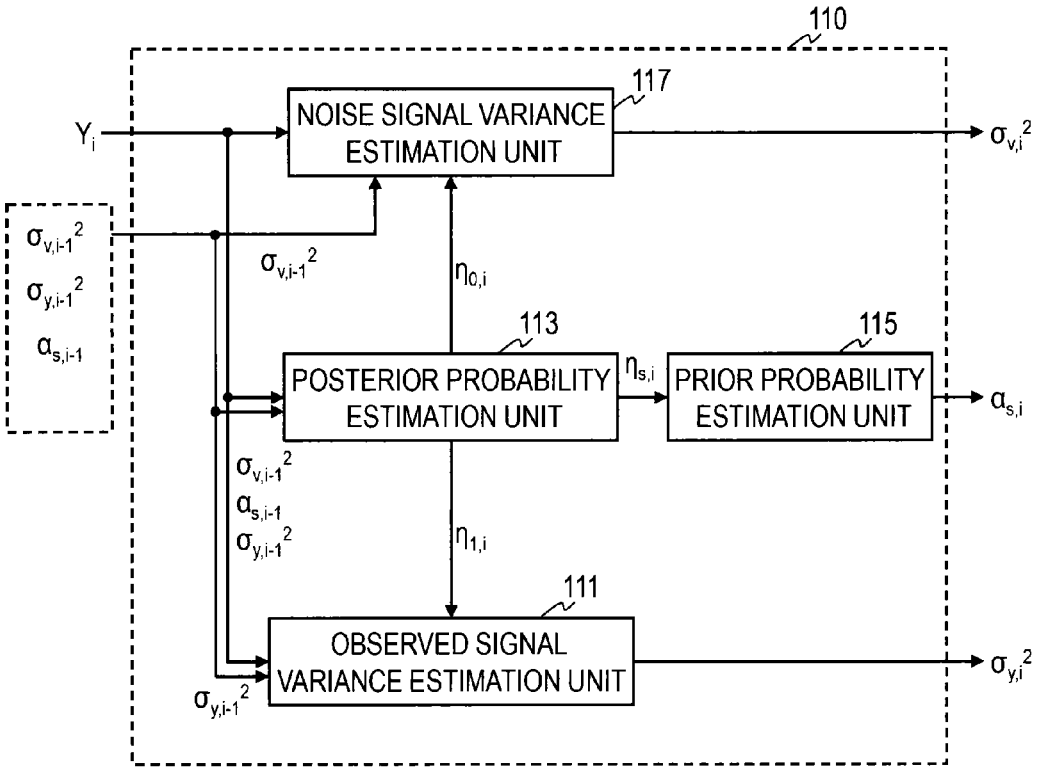
FIG. 10 is a functional block diagram of a noise estimation apparatus according to a modification of the first embodiment.
Figure 11:
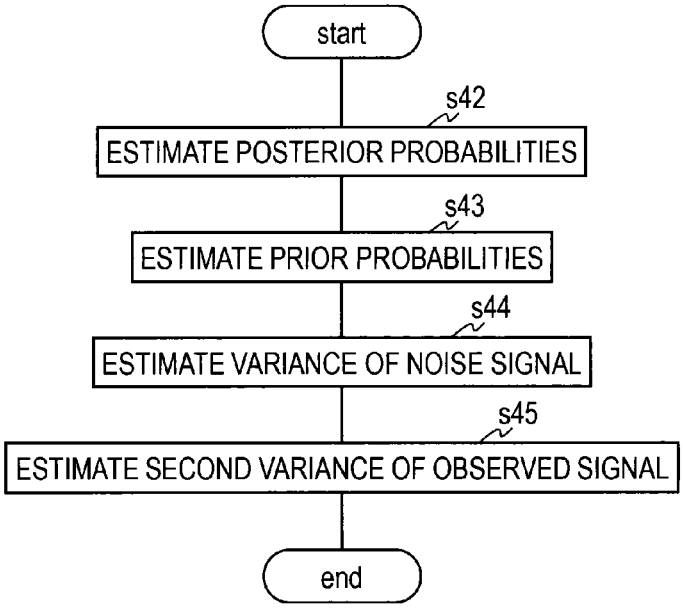
FIG. 11 is a view showing a processing flow in the noise estimation apparatus according to the modification of the first embodiment.

The first variance $\sigma_{y,i,1}^2$ need not be estimated (s41). The functional block diagram and the processing flow of the likelihood maximization unit 110 in that case are shown in FIG. 10 and FIG. 11 respectively. Let the variance of the observed signal in the current frame i be $\sigma_{y,i}^2$. The posterior probability estimation unit 113 performs estimation by using the variance $\sigma_{y,i-1}^2$ in the immediately preceding frame i−1 instead of the first variance $\sigma_{y,i,1}^2$. In that case, there is no need to store the speech posterior probability $\eta_{1,i}(\alpha_{0,i-1},\theta_{i-1})$ and the non-speech posterior probability $\eta_{0,i}(\alpha_{0,i-1},\theta_{i-1})$ in the storage unit 120. However, a higher noise estimation precision can be achieved through obtaining the first variance $\sigma_{y,i,1}^2$ by using $\beta_{i-1}$, calculating $\beta_i$, and then making an adjustment to obtain the second variance $\sigma_{y,i,2}^2$. This is because all the parameters are estimated in a form matching the current observation by using the first variance, in which the complex spectrum of the observed signal in the current frame is reflected, rather than by using the variance of the immediately preceding frame. Not estimating the first variance $\sigma_{y,i,1}^2$ has the advantage of reducing the amount of calculation in comparison with the first embodiment and has the disadvantage of a low noise estimation precision.

In step s4 in this embodiment, the likelihood maximization unit 110 obtains the speech prior probability $\alpha_{1,i}$, the non-speech prior probability $\alpha_{0,i}$, the non-speech posterior probability $\eta_{0,1}$, the speech posterior probability $\eta_{1,i}$, and the variance $\sigma_{x,i}^2$ of the desired signal in the current frame i in order to perform successive estimation of the variance $\sigma_{v,i}^2$ of the noise signal in the current frame i (to estimate the variance $\sigma_{v,i}^2$ of the noise signal in the subsequent frame i+1 as well). If just the variance $\sigma_{v,i}^2$ of the noise signal in the current frame i should be estimated, there is no need to obtain the speech prior probability $\alpha_{1,i}$, the non-speech prior probability $\alpha_{0,i}$, the non-speech posterior probability $\eta_{0,i}$, the speech posterior probability $\eta_{1,i}$, and the variance $\sigma_{x,i}^2$ of the desired signal in the current frame i.

Although the parameters estimated in the frame i−1 immediately preceding the current frame i are taken from the storage unit 120 in step s4 in this embodiment, the parameters do not always have to pertain to the immediately preceding frame i−1, and parameters estimated in a given past frame i−τ may be taken from the storage unit 120, where τ is an integer not smaller than 1.

Although the observed signal variance estimation unit 111 estimates the first variance $\sigma_{y,i,1}^2$ of the observed signal in the current frame i on the basis of the speech posterior probability $\eta_{1,i-1}(\alpha_{0,i-2},\theta_{i-2})$ estimated in the immediately preceding frame i−1 by using parameters $\alpha_{0,i-2}$ and $\theta_{i-2}$ estimated in the second preceding frame i−2, the first variance $\sigma_{y,i,1}^2$ of the observed signal in the current frame i may be estimated on the basis of the speech posterior probability estimated in an earlier frame i−τ by using parameters $\alpha_{0,i-\tau'}$ and $\theta_{i-\tau'}$ estimated in a frame i−τ' before the frame i−τ. Here, τ' is an integer larger than τ.

In step s4 in this embodiment, when the complex spectrum $Y_i$ of the observed signal in the current frame i is received, the parameters are obtained by using the complex spectra $Y_0, Y_1, \ldots, Y_i$ of the observed signal up to the current frame i, such that the following is maximized.

$$Q_i(\alpha_0, \theta) = \sum_{t=0}^{i} \lambda^{i-t} \sum_{s=0}^{1} \eta_{s,t}(\alpha_0', \theta') \log[\alpha_s p(Y_t \mid H_s; \theta)]$$

Here, $Q(\alpha_0, \theta)$ may be obtained by using all values of the complex spectra $Y_0, Y_1, \ldots, Y_i$ of the observed signal up to the current frame i. Alternatively, the parameters may also be obtained by using $Q_{i-1}$ obtained in the immediately preceding frame i−1 and the complex spectrum $Y_i$ of the observed signal in the current frame i (by indirectly using the complex spectra $Y_0, Y_1, \ldots, Y_{i-1}$ of the observed signal up to the immediately preceding frame i−1) such that the following is maximized.

$$Q_i(\alpha_0, \theta) = Q_{i-1}(\alpha'_0, \theta') + \sum_{s=0}^{1} \eta_{s,t}(\alpha'_0, \theta')\log[\alpha_s p(Y_i \mid H_s; \theta)]$$

Therefore, $Q_i(\alpha_0, \theta)$ should be obtained by using at least the complex spectrum $Y_i$ of the observed signal of the current frame.

In step s4 in this embodiment, the parameters are determined to maximize $Q_i(\alpha_0, \theta)$. This value should not always be maximized at once. Parameter estimation on the likelihood maximization criterion can be performed by repeating several times the step of determining the parameters such that the value $Q_i(\alpha_0, \theta)$ based on the log likelihood log $[\alpha_s p(Y_i|H_s;\theta)]$ after the update is larger than the value $Q_i(\alpha_0, \theta)$ based on the log likelihood log $[\alpha_s p(Y_i|H_s;\theta)]$ before the update.

The present invention is not limited to the embodiment and the modifications described above. For example, each type of processing described above may be executed not only time sequentially according to the order of description but also in parallel or individually when necessary or according to the processing capabilities of the apparatus executing the processing. Appropriate changes can be made without departing from the scope of the present invention.

Program and Recording Medium

The noise estimation apparatus described above can also be implemented by a computer. A program for making the computer function as the target apparatus (apparatus having the functions indicated in the drawings in each embodiment) or a program for making the computer carry out the steps of procedures (described in each embodiment) should be loaded into the computer from a recording medium such as a CD-ROM, a magnetic disc, or a semiconductor storage or through a communication channel, and the program should be executed.

INDUSTRIAL APPLICABILITY

The present invention can be used as an elemental technology of a variety of acoustic signal processing systems. Use of the technology of the present invention will help improve the overall performance of the systems. Systems in which the process of estimating a noise component included in a generated speech signal can be an elemental technology that can contribute to the improvement of the performance include the following. Speech recorded in actual environments always includes noise, and the following systems are assumed to be used in those environments.

1. Speech recognition system used in actual environments
2. Machine control interface that gives a command to a machine in response to human speech and man-machine dialog apparatus
3. Music information processing system that searches for or transcripts a piece of music by eliminating noise from a song sung by a person, music played on an instrument, or music output from a speaker
4. Voice communication system which collects a voice by using a microphone, eliminates noise from the collected voice, and allows the voice to be reproduced by a remote speaker.

What is claimed is:

1. A noise estimation apparatus comprising:

circuitry configured to receive, as an input, complex spectra of inputted observed waveform signals, which are acoustic signals that include clean speech mixed with a noise signal, up to a current frame;

obtain a variance of the noise signal, where the noise signal follows a complex Gaussian distribution, such that a value of weighted addition of sums becomes large, wherein:

each of the sums is obtained by adding a first product and a second product; the first product in each frame is a product of a log likelihood of a model of an observed signal expressed by a Gaussian distribution in a speech segment and a speech posterior probability; and the second product in each frame is a product of a log likelihood of a model of an observed signal expressed by a Gaussian distribution in a non-speech segment and a non-speech posterior probability; and the circuitry is further configured to estimate a variance $\sigma_{v,i}^2$ of the noise signal in the current frame i by weighted addition of a complex spectrum $Y_i$ of an observed signal in the current frame i and a variance $\sigma_{v,i-\tau}^2$ of the noise signal estimated in a past frame i−τ, where τ is an integer greater than 1, on the basis of a non-speech posterior probability estimated in the current frame i, wherein the circuitry is configured to output the variance $\sigma_{v,i}^2$ of the noise signal for cancellation of the noise signal from the acoustic signals, wherein the cancellation of the noise signal includes subtracting a power spectrum of the noise signal, which is estimated based on the outputted variance $\sigma_{v,i}^2$, from a power spectrum of the observed waveform signals.

2. The noise estimation apparatus according to claim 1, wherein the observed waveform signals include an observed signal in the current frame, and the circuitry is configured to obtain the variance of the noise signal, a speech prior probability, a non-speech prior probability, and a variance of a desired signal such that the value of the weighted addition of the sums becomes large.

3. The noise estimation apparatus according to claim 1, wherein a greater weight in the weighted addition is assigned to a frame closer to the current frame.

4. The noise estimation apparatus according to claim 2, wherein a greater weight in the weighted addition is assigned to a frame closer to the current frame.

5. The noise estimation apparatus according to one of claims 1 to 3 and 4, wherein the circuitry is further configured to estimate a first variance $\sigma_{y,i,1}^2$ of the observed signal in the current frame i by weighted addition of the complex spectrum $Y_i$ of the observed signal in the current frame i and a second variance $\sigma_{y,i-\tau,2}^2$ of the observed signal estimated in the past frame i−τ, on the basis of the speech posterior probability estimated in the past frame i−τ;

estimate a speech posterior probability $\eta_{1,i}(\alpha_{0,i-\tau},\theta_{i-\tau})$ and a non-speech posterior probability $\eta_{0,i}(\alpha_{0,i-\tau},\theta_{i-\tau})$ for the current frame i by using the complex spectrum $Y_i$ of the observed signal and the first variance $\sigma_{y,i,1}^2$ of the observed signal in the current frame and a speech prior probability $\alpha_{1,i-\tau}$ and a non-speech prior probability $\alpha_{0,i-\tau}$ estimated in the past frame i−τ, assuming that the complex spectrum $Y_i$ of the observed signal in the non-speech segment follows a Gaussian distribution determined by the variance $\sigma_{v,i-\tau}^2$ of the noise signal and assuming that the complex spectrum $Y_i$ of the observed signal in the speech segment follows a Gaussian distribution determined by the variance $\sigma_{v,i-\tau}^2$ of the noise signal and the first variance $\sigma_{y,i,1}^2$ of the observed signal;

estimate values obtained by weighted addition of speech posterior probabilities and weighted addition of non-speech posterior probabilities estimated up to the current frame i as a speech prior probability $\alpha_{1,i}$ and a non-speech prior probability $\alpha_{0,i}$, respectively; and estimate a second variance $\sigma_{y,i,2}^2$ of the observed signal in the current frame i by weighted addition of the complex spectrum $Y_i$ of the observed signal in the current frame i and the second variance $\sigma_{y,i-\tau,2}^2$ of the observed signal estimated in the past frame i−τ, on the basis of the speech posterior probability estimated in the current frame i.

6. The noise estimation apparatus according to one of claims 1 to 3 and 4, wherein the circuitry is further configured to estimate a speech posterior probability $\eta_{1,i}(\alpha_{0,i-\tau},\theta_{1-\tau})$ and a non-speech posterior probability $\eta_{0,i}(\alpha_{0,i-\tau},\theta_{i-\tau})$ for the current frame i by using the complex spectrum $Y_i$ of the observed signal in the current frame i and a variance $\sigma_{y,i-\tau}^2$ of the observed signal, a speech prior probability $\alpha_{1,i-\tau}$, and a non-speech prior probability $\alpha_{0,i-\tau}$ estimated in the past frame i−τ, assuming that the complex spectrum $Y_i$ of the observed signal in the non-speech segment follows a Gaussian distribution determined by the variance of the noise signal and assuming that the complex spectrum $Y_i$ of the observed signal in the speech segment follows a Gaussian distribution determined by the variance $\sigma_{v,i-\tau}^2$ of the noise signal and a variance $\sigma_{y,i}^2$ of the observed signal;

estimate values obtained by weighted addition of speech posterior probabilities and weighted addition of non-speech posterior probabilities estimated up to the current frame i as a speech prior probability $\alpha_{1,i}$ and a non-speech prior probability $\alpha_{0,i}$, respectively; and estimate the variance $\sigma_{y,i}^2$ of the observed signal in the current frame i by weighted addition of the complex spectrum $Y_i$ of the observed signal in the current frame i and the variance $\sigma_{y,i-\tau}^2$ of the observed signal estimated in the past frame i−τ, on the basis of the speech posterior probability estimated in the current frame i.

7. The noise estimation apparatus according to claim 5, wherein the circuitry is further configured to estimate the first variance $\sigma_{y,i,1}^2$ of the observed signal in the current frame i, as given below, by using the complex spectrum $Y_i$ of the observed signal in the current frame i and the second variance $\sigma_{y,i-\tau,2}^2$ of the observed signal estimated in the past frame i−τ, where 0<λ<1 and is an integer larger than τ

$$\theta_{i-\tau'} = [\sigma_{v,i-\tau'}^2, \sigma_{x,i-\tau'}^2]^T$$

$$c_{1,i-\tau} = \lambda c_{1,i-\tau'} + \eta_{1,i-\tau}(\alpha_{0,i-\tau'}, \theta_{i-\tau'})$$

$$\beta_{1,i-\tau} = \frac{n_{1,i-\tau}(\alpha_{0,i-\tau'}, \theta_{i-\tau'})}{c_{1,i-\tau}}$$

$$\sigma_{y,i,1}^2 = (1-\beta_{1,i-\tau})\sigma_{y,i-\tau,2}^2 + \beta_{1,i-\tau}|Y_i|^2,$$

estimate the speech posterior probability $\eta_{1,i}(\alpha_{0,i-\tau},\theta_{i-\tau})$ and the non-speech posterior probability $\eta_{0,i}(\alpha_{0,i-\tau},\theta_{i-\tau})$ for the current frame i, as given below, by using the complex spectrum $Y_i$ of the observed signal and the first variance $\sigma_{y,i,1}^2$ of the observed signal in the current frame i and the speech prior probability $\alpha_{1,i-\tau}$, the non-speech prior probability $\alpha_{0,i-\tau}$, and the variance $\sigma_{v,i-\tau}^2$ of the noise signal estimated in the past frame where s=0 or s=1

$$\sigma_{x,i-\tau}^2 = \sigma_{y,i,1}^2 - \sigma_{v,i-\tau}^2$$

$$p(Y_i \mid H_0; \theta_{i-\tau}) = \frac{1}{\pi\sigma_{v,i-\tau}^2} e^{-\frac{|Y_i|^2}{\sigma_{v,i-\tau}^2}}$$

$$p(Y_i \mid H_1; \theta_{i-\tau}) = \frac{1}{\pi(\sigma_{v,i-\tau}^2 + \sigma_{x,i-\tau}^2)} e^{-\frac{|Y_i|^2}{\sigma_{v,i-\tau}^2+\sigma_{x,i-\tau}^2}}$$

$$\eta_{s,i}(\alpha_{0,i-\tau}, \theta_{i-\tau}) = \frac{\alpha_{s,i-\tau} p(Y_i \mid H_s; \theta_{i-\tau})}{\alpha_{0,i-\tau} p(Y_i \mid H_0; \theta_{i-\tau}) + (1-\alpha_{0,i-\tau}) p(Y_i \mid H_1; \theta_{i-\tau})}$$

estimate the speech prior probability $\alpha_{1,i}$ and the non-speech prior probability $\alpha_{0,i}$, as given below, by using the speech posterior probability $\eta_{1,i}(\alpha_{0,i-\tau},\theta_{i-\tau})$ and the non-speech posterior probability $\eta_{0,i}(\alpha_{0,i-\tau},\theta_{i-\tau})$ estimated in the current frame i $$c_{s,i} = \lambda c_{s,i-\tau} + \eta_{s,i}(\alpha_{0,i-\tau}, \theta_{i-\tau})$$

$$c_i = c_{0,i} + c_{1,i}$$

$$\alpha_{s,i} = \frac{c_{s,i}}{c_i},$$

estimate the variance $\sigma_{v,i}^2$ of the noise signal in the current frame i, as given below, by using the complex spectrum $Y_i$ of the observed signal, the non-speech posterior probability $\eta_{0,1}(\alpha_{0,i-\tau},\theta_{i-\tau})$ estimated in the current frame i, and the variance $\sigma_{v,i-\tau}^2$ of the noise signal estimated in the past frame i−τ

$$\beta_{0,i} = \frac{\eta_{0,i}(\alpha_{0,i-\tau}, \theta_{i-\tau})}{c_{0,i}}$$

$$\sigma_{v,i}^2 = (1-\beta_{0,i})\sigma_{v,i-\tau}^2 + \beta_{0,i}|Y_i|^2, \text{ and}$$

estimate the second variance $\sigma_{y,i,2}^2$ of the observed signal in the current frame i, as given below, by using the complex spectrum $Y_i$ of the observed signal in the current frame i, the speech posterior probability $\eta_{1,i}(\alpha_{0,i-\tau},\theta_{i-\tau})$ estimated in the current frame i, and the second variance $\sigma_{y,i-\tau,2}^2$ of the observed signal estimated in the past frame i−τ

$$\beta_{1,i} = \frac{n_{1,i}(\alpha_{0,i-\tau}, \theta_{i-\tau})}{c_{1,i}}$$

$$\sigma_{y,i,2}^2 = (1-\beta_{1,i})\sigma_{y,i-\tau,2}^2 + \beta_{1,i}|Y_i|^2 c.$$

8. A noise estimation method comprising:

a step, by circuitry of a noise estimation apparatus, of receiving, as an input, complex spectra of inputted observed waveform signals, which are acoustic signals that include clean speech mixed with a noise signal, up to a current frame;

obtaining a variance of the noise signal, where the noise signal follows a complex Gaussian distribution, such that a value of weighted addition of sums becomes large, wherein:

each of the sums is obtained by adding a first product and a second product; the first product in each frame is a product of a log likelihood of a model of an observed signal expressed by a Gaussian distribution in a speech segment and a speech posterior probability; and the second product in each frame is a product of a log likelihood of a model of an observed signal expressed by a Gaussian distribution in a non-speech segment and a non-speech posterior probability; and the method includes estimating, by the circuitry, a variance $\sigma_{v,i}^2$ of the noise signal in the current frame i by weighted addition of a complex spectrum $Y_i$ of an observed signal in the current frame i and a variance $\sigma_{v,i-\tau}^2$ of the noise signal estimated in a past frame where $\tau$ is an integer greater than 1, on the basis of a non-speech posterior probability estimated in the current frame, and outputting the variance $\sigma_{v,i}^2$ of the noise signal for cancellation of the noise signal from the acoustic signals, wherein the cancellation of the noise signal includes subtracting a power spectrum of the noise signal, which is estimated based on the outputted variance $\sigma_{v,i}^2$ from a power spectrum of the observed waveform signals.

9. The noise estimation method according to claim 8, wherein in the step, the observed waveform signals include an observed signal in the current frame, and the variance of the noise signal, a speech prior probability, a non-speech prior probability and a variance of a desired signal such that the value of the weighted addition of the sums becomes large are obtained.

10. The noise estimation method according to claim 8, wherein a greater weight in the weighted addition is assigned to a frame closer to the current frame.

11. The noise estimation method according to claim 9, wherein a greater weight in the weighted addition is assigned to a frame closer to the current frame.

12. The noise estimation method according to one of claims 8-10 and 11, further comprising:

a first observed signal variance estimation step of estimating a first variance $\sigma_{y,i,1}^2$ of the observed signal in the current frame i by weighted addition of the complex spectrum $Y_i$ of the observed signal in the current frame i and a second variance $\sigma_{y,i-\tau,2}^2$ of the observed signal estimated in the past frame i–$\tau$, on the basis of the speech posterior probability estimated in the past frame i–$\tau$;

a posterior probability estimation step of estimating a speech posterior probability $\eta_{1,i}(\alpha_{0,i-\tau},\theta_{i-\tau})$ and a non-speech posterior probability $\eta_{0,i}(\alpha_{0,i-\tau},\theta_{i-\tau})$ for the current frame i by using the complex spectrum $Y_i$ of the observed signal and the first variance $\sigma_{y,i,1}^2$ of the observed signal in the current frame and a speech prior probability $\alpha_{1,i,\tau}$ and a non-speech prior probability $\alpha_{0,i-\tau}$ estimated in the past frame i–$\tau$, assuming that the complex spectrum $Y_i$ of the observed signal in the non-speech segment follows a Gaussian distribution determined by the variance $\sigma_{v,i-\tau}^2$ of the noise signal and assuming that the complex spectrum $Y_i$ of the observed signal in the speech segment follows a Gaussian distribution determined by the variance $\sigma_{v,i-\tau}^2$ of the noise signal and the first variance $\sigma_{y,i,1}^2$ of the observed signal, and a prior probability estimation step of estimating values obtained by weighted addition of speech posterior probabilities and weighted addition of non-speech posterior probabilities estimated up to the current frame i as a speech prior probability $\alpha_{1,i}$ and a non-speech prior probability $\alpha_{0,i}$, respectively; and a second observed signal variance estimation step of estimating a second variance $\sigma_{y,i,2}^2$ of the observed signal in the current frame i by weighted addition of the complex spectrum $Y_i$ of the observed signal in the current frame i and the second variance $\sigma_{y,i-\tau,2}^2$ of the observed signal estimated in the past frame i–$\tau$, on the basis of the speech posterior probability estimated in the current frame i.

13. The noise estimation method according to one of claims 8-10 and 11, further comprising:

a posterior probability estimation step of estimating a speech posterior probability $\eta_{1,i}(\alpha_{0,i-\tau},\theta_{i-\tau})$ and a non-speech posterior probability $\eta_{0,i}(\alpha_{0,i-\tau},\theta_{i-\tau})$ for the current frame i by using the complex spectrum $Y_i$ of the observed signal in the current frame i and a variance $\sigma_{y,i-\tau}^2$ of the observed signal, a speech prior probability $\alpha_{1,i-\tau}$, and a non-speech prior probability $\alpha_{0,i-\tau}$ estimated in the past frame i–$\tau$, assuming that the complex spectrum $Y_i$ of the observed signal in the non-speech segment follows a Gaussian distribution determined by the variance $\sigma_{y,i-\tau}^2$ of the noise signal and assuming that the complex spectrum $Y_i$ of the observed signal in the speech segment follows a Gaussian distribution determined by the variance $\sigma_{v,i-\tau}^2$ of the noise signal and a variance $\sigma_{y,i}^2$ of the observed signal;

a prior probability estimation step of estimating values obtained by weighted addition of speech posterior probabilities and weighted addition of non-speech posterior probabilities estimated up to the current frame i as a speech prior probability $\alpha_{1,i}$ and a non-speech prior probability $\alpha_{0,i}$, respectively; and an observed signal variance estimation step of estimating the variance $\sigma_{y,i}^2$ of the observed signal in the current frame i by weighted addition of the complex spectrum $Y_i$ of the observed signal in the current frame i and the variance $\sigma_{y,i-\tau}^2$ of the observed signal estimated in the past frame i–$\tau$, on the basis of the speech posterior probability estimated in the current frame i.

14. A non-transitory computer-readable recording medium having recorded thereon a noise estimation program which when executed by a noise estimation apparatus, causes the noise estimation apparatus to perform a method comprising:

a step, by circuitry of a noise estimation apparatus, of receiving, as an input, complex spectra of inputted observed waveform signals, which are acoustic signals that include clean speech mixed with a noise signal, up to a current frame;

obtaining a variance of the noise signal, where the noise signal follows a complex Gaussian distribution, such that a value of weighted addition of sums becomes large, wherein:

each of the sums is obtained by adding a first product and a second product, the first product in each frame is a product of a log likelihood of a model of an observed signal expressed by a Gaussian distribution in a speech segment and a speech posterior probability; and the second product in each frame is a product of a log likelihood of a model of an observed signal expressed by a Gaussian distribution in a non-speech segment and a non-speech posterior probability; and the method includes estimating, by the circuitry, a variance $\sigma_{v,i}^2$ of the noise signal in the current frame i by weighted addition of a complex spectrum $Y_i$ of an observed signal in the current frame i and a variance $\sigma_{v,i-\tau}^2$ of the noise signal estimated in a past frame where $\tau$ is an integer greater than 1, on the basis of a non-speech posterior probability estimated in the current frame, and outputting the variance $\sigma_{v,i}^2$ of the noise signal for cancellation of the noise signal from the acoustic signals, wherein the cancellation of the noise signal includes subtracting a power spectrum of the noise signal, which is estimated based on the outputted variance $\sigma_{v,i}^2$, from a power spectrum of the observed waveform signals.

* * * * *